US008006390B2

(12) United States Patent
Mueller et al.

(10) Patent No.: US 8,006,390 B2
(45) **Date of Patent: *Aug. 30, 2011**

(54) MEDIA CUTTING AND RIBBON CURLING DEVICE

(75) Inventors: Gerald E. Mueller, Eagan, MN (US); Joy A. Packard, Somerset, WI (US); Scott D. Pearson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 286 days.

This patent is subject to a terminal disclaimer.

(21) Appl. No.: 11/560,901

(22) Filed: Nov. 17, 2006

(65) Prior Publication Data

US 2007/0249477 A1 Oct. 25, 2007

Related U.S. Application Data

(63) Continuation-in-part of application No. 11/408,781, filed on Apr. 21, 2006.

(51) Int. Cl.
*B26B 11/00* (2006.01)

(52) U.S. Cl. ..... 30/294; 30/280; 30/295; 493/459

(58) Field of Classification Search ..... 30/2, 278, 30/280, 286, 289–291, 294, 295, 314, 317; 493/459, 462; D8/98, 104–105, 107
See application file for complete search history.

(56) References Cited

U.S. PATENT DOCUMENTS

| | | | | |
|---|---|---|---|---|
| 515,094 | A | | 2/1894 | Payne |
| 521,115 | A | | 6/1894 | Hopper |
| 1,399,924 | A | | 12/1921 | Berthelsen |
| 1,566,878 | A | | 12/1925 | Jones |
| 2,050,768 | A | * | 8/1936 | Seymour ..... 30/2 |
| D109,355 | S | * | 1/1938 | Temple ..... D24/110 |
| 2,274,978 | A | | 3/1942 | Currier |
| 2,294,018 | A | * | 8/1942 | Borst ..... 30/294 |
| 2,329,805 | A | | 9/1943 | Wilson, Sr. |
| 2,389,648 | A | | 11/1945 | Stafford |

(Continued)

FOREIGN PATENT DOCUMENTS

DE 3614860 A1 11/1987

(Continued)

OTHER PUBLICATIONS

"The Ribbon-Master®" from Group One Limited, [retrieved from the internet Dec. 5, 2005], URL http://www.grouponelimited.com/rib_mast.htm, pp. 1-4.

(Continued)

*Primary Examiner* — Edward F Landrum
(74) *Attorney, Agent, or Firm* — Lisa P. Fulton; Yen T. Florczak

(57) ABSTRACT

A media cutting and ribbon curling device has opposing first and second surfaces bound by two side edges. The device includes a head comprising a cover and a guide disposed underneath the cover, the guide having an attached end and a free end and a blade disposed therein; and an elongated handle extending from the attached end of the guide, the handle comprising a ribbon curling region having (i) first and second ends, the first end disposed proximate to the attached end of the guide and (ii) a curling edge disposed on at least one of the first and second surfaces of the device, the ribbon curling region being tapered at its second end.

18 Claims, 10 Drawing Sheets

U.S. PATENT DOCUMENTS

| | | | | | |
|---|---|---|---|---|---|
| 2,428,490 | A | | 10/1947 | Goughnour | |
| 2,571,234 | A | | 10/1951 | Guest | |
| 2,597,540 | A | | 5/1952 | Smith | |
| 2,610,399 | A | | 9/1952 | Adams et al. | |
| 2,645,007 | A | | 7/1953 | Alfredsson et al. | |
| 3,028,670 | A | | 4/1962 | Tilly | |
| 3,159,913 | A | | 12/1964 | Winton | |
| 3,230,620 | A | * | 1/1966 | McKinley | 30/286 |
| 3,365,798 | A | | 1/1968 | Cunningham | |
| 3,374,541 | A | | 3/1968 | Earnest, III et al. | |
| 3,673,687 | A | | 7/1972 | Phillips et al. | |
| D230,007 | S | | 1/1974 | Cramer | |
| 3,815,231 | A | | 6/1974 | Greenberg | |
| 3,824,688 | A | | 7/1974 | Goffe | |
| 3,835,536 | A | | 9/1974 | Marcoux | |
| 3,883,953 | A | | 5/1975 | Saullo et al. | |
| 4,001,934 | A | | 1/1977 | Bell | |
| D245,062 | S | * | 7/1977 | Grame | D8/83 |
| 4,106,196 | A | | 8/1978 | Smithline | |
| 4,134,206 | A | | 1/1979 | Beermann | |
| D254,243 | S | | 2/1980 | Florian et al. | |
| D263,445 | S | * | 3/1982 | Gordin et al. | D8/107 |
| 4,373,263 | A | | 2/1983 | Ayers | |
| D269,154 | S | | 5/1983 | Freedman et al. | |
| 4,581,823 | A | | 4/1986 | Gilman | |
| D291,651 | S | | 9/1987 | Sieg et al. | |
| 4,831,734 | A | | 5/1989 | De Ruyter et al. | |
| D305,499 | S | | 1/1990 | Walker | |
| 4,980,942 | A | * | 1/1991 | Spargo, Sr. | 7/158 |
| D320,150 | S | | 9/1991 | Huang | |
| 5,046,253 | A | | 9/1991 | Ireland | |
| 5,054,699 | A | * | 10/1991 | DeJaynes | 241/101.2 |
| 5,072,515 | A | | 12/1991 | Heitz | |
| D323,967 | S | * | 2/1992 | Talbot | D8/98 |
| 5,205,007 | A | * | 4/1993 | Goldstein | 7/135 |
| 5,232,132 | A | | 8/1993 | Broussard et al. | |
| 5,285,575 | A | | 2/1994 | Hirano | |
| 5,400,452 | A | * | 3/1995 | Goldstein | 7/135 |
| D362,168 | S | | 9/1995 | Mancini | |
| 5,480,080 | A | | 1/1996 | Ferguson | |
| 5,564,145 | A | * | 10/1996 | Goldstein | 7/158 |
| 5,638,603 | A | | 6/1997 | Li | |
| 5,662,669 | A | | 9/1997 | Abidin et al. | |
| 5,697,938 | A | | 12/1997 | Jensen et al. | |
| 5,724,738 | A | | 3/1998 | Ballarini | |
| 5,737,842 | A | | 4/1998 | Freedman | |
| 5,758,422 | A | | 6/1998 | Frank | |
| 5,768,787 | A | | 6/1998 | Ireland | |
| 5,809,656 | A | | 9/1998 | Lindberg | |
| 5,896,667 | A | | 4/1999 | Hawkins | |
| 5,964,388 | A | | 10/1999 | Jennings et al. | |
| 5,983,505 | A | | 11/1999 | Gibson | |
| 6,003,181 | A | | 12/1999 | Wenk | |
| D423,318 | S | | 4/2000 | Lacy | |
| D424,397 | S | | 5/2000 | Wiseman | |
| 6,131,223 | A | * | 10/2000 | Rehkemper et al. | 7/158 |
| 6,240,645 | B1 | | 6/2001 | Ozeki | |
| 6,371,844 | B1 | * | 4/2002 | Holler | 452/132 |
| 6,493,945 | B1 | | 12/2002 | DeRosa et al. | |
| 6,578,266 | B2 | | 6/2003 | Chomiak | |
| 6,615,495 | B1 | | 9/2003 | Evens et al. | |
| D481,609 | S | | 11/2003 | Perlmutter et al. | |
| 6,941,664 | B1 | | 9/2005 | Engle et al. | |
| D514,916 | S | | 2/2006 | Craig | |
| 7,003,884 | B2 | | 2/2006 | Perlmutter et al. | |
| D525,852 | S | | 8/2006 | Pearson et al. | |
| D527,603 | S | | 9/2006 | Gullicks et al. | |
| 2004/0088868 | A1 | | 5/2004 | Fazio | |
| 2006/0236550 | A1 | | 10/2006 | Gullicks et al. | |
| 2007/0245571 | A1 | | 10/2007 | Pearson | |

FOREIGN PATENT DOCUMENTS

| | | | |
|---|---|---|---|
| DE | 196 54 034 | | 7/1997 |
| DE | 202 14 317 | | 9/2002 |
| EP | 771256 | B1 | 9/1999 |
| FR | 965628 | | 9/1950 |
| JP | 05-318333 | | 12/1993 |
| JP | 2001-62162 | | 3/2001 |
| JP | 2001-198368 | | 7/2001 |
| KR | 20-0240124 | | 7/2001 |
| KR | 20-0243780 | | 8/2001 |
| WO | WO 95/35190 | | 12/1995 |
| WO | WO 01/14108 | A1 | 3/2001 |

OTHER PUBLICATIONS

"The Mini-Master™", from Group One Limited, [retrieved from the internet Dec. 5, 2005], URL http://www.grouponelimited.com/mini_mas.htm, pp. 1-3.

"Film & Sheet Safety Cutters," Martor USA [on line], [retrieved from the internet Apr. 11, 2005], URL <http://www.martorusa.com/s.nl/sc.2/category.8/.f>, pp. 1-4.

"Snitty (On Card)—43037," Martor USA [on line], [retrieved from the internet Apr. 7, 2005], URL <http://www.martorusa.com/s.nl/sc.2/category.8/it.A/id.640/.f>, pp. 1-2 and 1.

"The Amazing Open X®," [on line], [retrieved from the internet Jun. 20, 2005], URL <http://www.myopenx.com/guarantee.htm>, pp. 1.

"World's Best Gift Wrap Cutter," New Design Inc., Vernon Hills, IL 60061, brochure, pp. 1-4.

"The Ribbon-Master®", from Group One Limited, [retrieved from the internet Dec. 5, 2005], URL http://www.grouponelimited.com/rib_mast.htm, pp. 1-4.

"The Mini-Master™", from Group One Limited, [retrieved from the internet Dec. 5, 2005], URL http://www.grouponelimited.com/mini_mas.htm, pp. 1-3.

* cited by examiner

MEDIA CUTTING AND RIBBON CURLING DEVICE

CROSS REFERENCE TO RELATED APPLICATIONS

This application is a continuation-in-part of U.S. patent application Ser. No. 11/408,781 filed on Apr. 21, 2006, now pending, which claims the benefit of U.S. Provisional Application Ser. Nos. 60/673,824, filed Apr. 22, 2005 and 60/699,905, filed Jul. 15, 2005, the disclosures of which are incorporated by reference in their entirety herein.

FIELD OF INVENTION

The present invention relates to a combination media cutting and ribbon curling device. In particular, the present invention relates to a hand held, portable, light weight device that is well suited for cutting media such as paper, plastic, metal films, fabrics, and cardboard boxes, and is well suited for curling ribbon, which is commonly used in gift wrapping.

BACKGROUND

There are a wide variety of devices available for cutting media such as, e.g., paper, plastic sheets, aluminum foil, felt, and photos. Perhaps the most commonly used device for cutting such media is a scissors. While scissors are commonplace, they do have some drawbacks. For example, scissors have exposed cutting edges, which can present safety hazards. In some instances, as with dull scissors, the media can gather and the resulting edge created by the scissors cut may be jagged and unsightly. Such jagged edges are undesirable in some applications, such as, e.g., in gift-wrapping packages.

There are a wide variety of designs for envelope openers available commercially. These devices are especially useful for cutting along a fold such as an envelope opener. However, they are not as well suited to cut media that does not contain a fold. Other types of cutters can leave marks on the media, marks such as scratches and folds near the cut edge. These marks are usually undesirable to the consumer.

There are a variety of devices available today for curling ribbon. A ribbon is typically a non-woven material, such as, e.g., polypropylene, that curls when a tension or a shear force is applied to its surface. Consumers have used a blade of a scissor to curl ribbon. Typically, using a finger (usually the thumb) the consumer pushes the ribbon against the scissor blade and pulls the ribbon through thereby applying tension to the ribbon and curling it.

There are devices that combine ribbon curling and ribbon shredding, such as those disclosed in U.S. Pat. No. 5,232,132 (Broussard et al.) and U.S. Pat. No. 3,883,953 (Saullo et al.), where the curling and shredding processes are combined in one step. In U.S. Pat. No. 5,054,699 (DeJaynes), the ribbon curling process is separate from the ribbon shredding process. Besides scissors, there are also devices that combine cutting and curling ribbon, such as those disclosed in U.S. Pat. No. 5,205,007 (Goldstein) and Publication WO 95/35190.

SUMMARY

The present invention provides for a light-weight, hand held, portable media cutting and ribbon curling device for cutting straight lines, patterns, or curves on media and for curling ribbon. Exemplary media includes, but is not limited to, paper (such as gift wrapping paper, wax paper, photo paper), plastic, metal film such as aluminum foils, fabrics such as felts, and cardboard. A user of the inventive device exerts minimal force on the media to cut it, which means that during use the user applies only the force necessary to cut the media. Thus, the user does not have to apply excessive compressive force onto the media, thereby pushing the device into the media. With the device, the user does not need to resort to a cutting mat to cut the media. Typically, a cutting mat is used where the cutting device has an exposed blade. The elimination of a cutting mat is especially useful in crafting applications.

In one aspect, the present invention pertains to a device for cutting media comprising (a) a body comprising a sidewall extending from the body; and (b) means for cutting the media disposed in the body, the means for cutting the media comprising a cutting edge having a leading edge and a trailing edge. The sidewall shrouds at least a portion of the cutting edge. With reference to the cutting edge, the sidewall comprises a media contact point that is disposed away from the trailing edge in the direction of the leading edge. In one embodiment, the sidewall does not extend beyond the leading edge of the cutting edge.

In another aspect, the present invention pertains to a media cutting device comprising (a) a body comprising a handle, a cover extending from the handle, and a sidewall extending from the cover, (b) a guide disposed generally beneath the cover and extending from the handle, and (c) a blade disposed in the guide, the blade having a leading edge and a trailing edge. The sidewall shrouds at least a portion of the blade. With reference to the blade, the sidewall comprises a media contact point that is disposed away from the trailing edge in the direction of the leading edge. In one embodiment, the sidewall does not extend beyond the leading edge of the blade.

In yet another aspect, the present invention pertains to a media cutting device having replaceable parts. This particular device comprises a head comprising a cover, a sidewall extending from the cover, and a guide disposed substantially under the cover, the guide having a blade disposed therein; a handle attached to the head; and means for engaging and disengaging the head from the handle.

In yet another aspect, the present invention pertains to a method of cutting media comprising the steps of (a) providing a device for cutting media comprising a body comprising a sidewall extending from the body; and means for cutting the media disposed in the body, the means for cutting the media comprising a cutting edge having a leading edge and a trailing edge, wherein the sidewall shrouds at least a portion of the cutting edge, and wherein the sidewall comprises a media contact point that is disposed away from the trailing edge in the direction of the leading edge; (b) providing media; and (c) sliding the device through the media thereby cutting it. During the cutting action, the sidewall and the cutting edge create a localized deformation in the media near the leading edge of the cutting edge.

In yet another aspect, the present invention pertains to a media cutting and ribbon curling device that has opposing first and second surfaces bound by two side edges. The device includes (a) a head comprising a cover and a guide disposed underneath the cover, the guide having an attached end and a free end and a blade disposed therein; and (b) an elongated handle extending from the attached end of the guide, the handle comprising a ribbon curling region having (i) first and second ends, the first end disposed proximate to the attached end of the guide and (ii) a curling edge disposed on at least one of the first and second surfaces of the device, the ribbon curling region being tapered at its second end. In one embodiment, the second end of the ribbon curling region is tapered.

One advantage of the design of the ribbon curling region is such that it allows the user to cut the media and further allows for comfortable placement of a finger, typically a thumb.

In yet another aspect, the present invention pertains to a method of curling a length of ribbon. The method comprises the steps of (i) providing a length of ribbon; (ii) providing the media cutting and ribbon curling device of the preceding paragraph; (iii) placing the ribbon against the curling edge; (iv) placing a finger across the curling edge on the device pushing the ribbon against the curling edge; and (v) pulling the length of the ribbon through while maintaining the ribbon against the curling edge.

As used herein, the "cutting edge" describes that portion of the means for cutting the media that cuts the media during use. As described in detail below, an exemplary means for cutting the media is a blade or a wire. The cutting edge may or may not be continuous. The entire length of the cutting edge may or may not be used during cutting. The "leading edge" describes a location on the cutting edge that first encounters the media when the device is used to cut the media. The "trailing edge" describes a location on the cutting edge that has the greatest change in elevation from the leading edge. The media has two major surfaces, a first surface and an opposite second surface. The "media contact point" of the sidewall describes general location where the sidewall makes contact with the first major surface of the media while the cutting edge makes contact with the second major surface of the media.

One advantage of the present invention relates to ease of use. Because the user simply pushes the device through a media, there is no opening and closing action like that of scissors and typically one uses less effort to cut the media. This advantage is well suited for users who may have difficulty with scissors, e.g., those users who may experience arthritis and especially young users.

Another advantage of the present invention relates to safety. While, in one embodiment, the means for cutting the media is replaceable, in many embodiments the cutting edge will not be exposed to the user when the device is used in its intended application. In one embodiment, the cutting edge can be rotated so as to expose a new area of the cutting edge when the existing area becomes dull.

Yet another advantage of the present invention is that it is versatile, meaning that it can cut straight lines as well as curves. This advantage means that the device is useful in many applications, such as, e.g., cutting gift-wrapping paper, cardboard boxes, fabrics, box sealing tape, etc. The device easily fits into the user's pockets, purse, or bag, and when the user reaches for the device, he or she will not be inadvertently cut by it due to the design. Furthermore, because, in some embodiments, the device has a substantially flat bottom and because of the low presentation of the cutting edge relative to the flat bottom, the device is suitable for cutting media supported by a tabletop or the like.

BRIEF DESCRIPTION OF THE DRAWINGS

The invention can further be described with reference to the following drawings, wherein.

The drawings are idealized, not drawn to scale, and are intended only for illustrative purposes.

DETAILED DESCRIPTION

Figure 1:
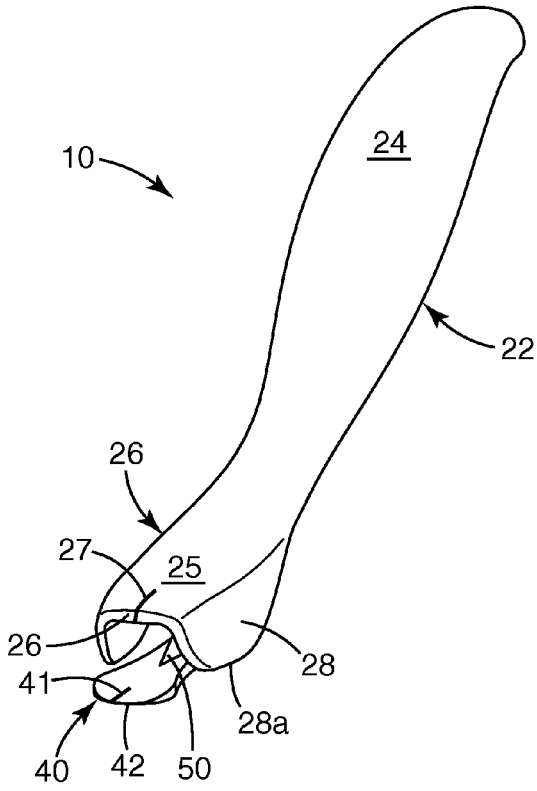
FIG. 1 is a perspective view of an exemplary embodiment of the present invention.
Figure 5:
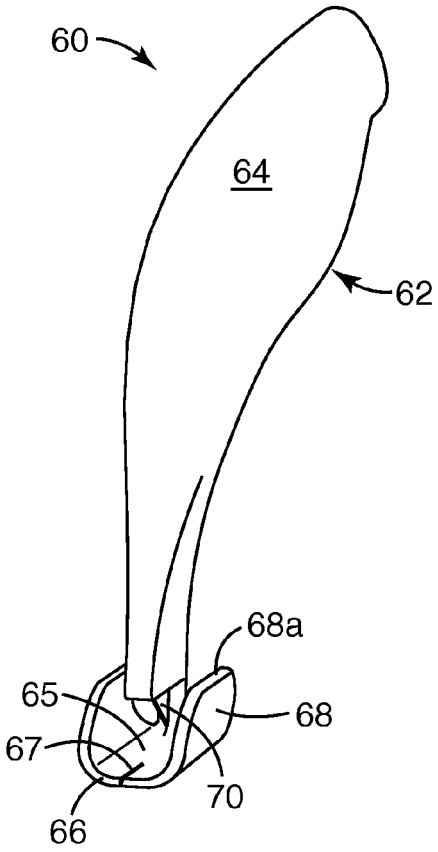
FIG. 5 is a perspective view of another exemplary embodiment of the present invention.

Referring generally to the embodiments in FIGS. 1 and 5, the device of the present invention 10, 60 includes body 22, 62, and sidewall 28, 68. The sidewall extends from the body. Although both embodiments show two sidewalls, the present invention can be practiced with one sidewall. The device further includes means for cutting the media. In the embodiments of FIGS. 1 and 5, the means for cutting the media is in the form of blade 50, 70. Although the embodiments in FIGS. 1 and 5 show the body to be an elongated, slender handle intended to be grasped by the user's palm, it is within the scope of the present invention for the body to be of other design. For example, the body could be oval or rectangular shaped and substantially flat so that it can be grasped between the user's thumb and forefinger. As yet another example, the body can be in the form of a "T" shaped bar, for grasping by the user's hand. To give some dimensions as examples and not as limitations, the body could have a length of about 4 to 6 inches (102 to 152 mm), and a width, at its widest point, of about 0.25 to 0.75 inches (6 to 19 mm).

Figure 2:
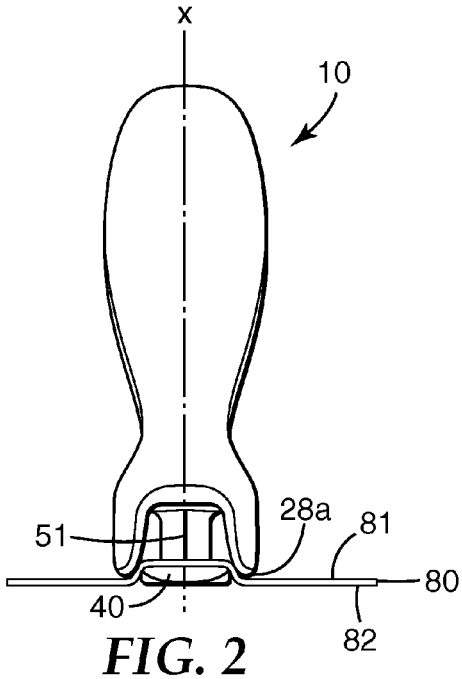
FIG. 2 is a front view of the embodiment of FIG. 1.

Referring now specifically to FIGS. 1 and 2, device 10 includes a body 22 and blade 50 disposed in optional guide 40. The body includes elongated handle 24, cover 25 extending from the handle, and sidewall 28 extending from cover. The cover has exposed end 26. Guide 40 includes free end 42. The device is shown in its cutting orientation, i.e., in its intended orientation when cutting the media. In one embodiment, the body, sidewall, and guide are integrally formed. It is within the scope of the present invention, however, for each of the three components to be formed separately and joined together by any suitable means.

In one exemplary embodiment, the cover and/or the guide can have a reference mark to help the user align the device with the media to facilitate accurate cutting. The reference mark can be especially useful where the media contains lines or patterns for the user to follow. In FIG. 1, reference mark 27 and 41 lie midway on the cover and guide respectively, although the reference mark can be in other location including the handle. In one embodiment, a visually guided mark is in the form of a light indicating means, such as a light emitting diode that projects a light beam onto the media. The light indicating means can be snapped onto the cutting device, or it can be an integral part of the cutting device. The light beam that projects onto the media may be colored, such as e.g., red or green light beams.

The body has a centerline, generally denoted as reference line "x". A portion of cover 25 is planar. The plane of the cover is generally coplanar to the plane of the media in regions away from the where the device has engaged the media. Other designs for the cover can be used to practice the present invention. If used, the guide lies below the sidewall. While sidewall 28 is shown to be generally trapezoidal in shape, it can be of any variety of geometry so long as it has a media contact point, denoted as reference 28*a*. The sidewall may have more than one media contact point. The sidewall extends from the cover so as to shroud at least a portion of blade 50. In this particular embodiment, the sidewall includes a curve in the region near the cover. The radius of curvature of the curve is relatively sharp, i.e., small radius, as the sidewall is nearly orthogonal to the plane of the cover. It is within the scope of the present invention to use a larger radius of curvature than what is shown in FIG. 1, so long as the sidewall has a media contact point. When the media lies horizontal, as best shown in FIG. 2, the device is operable even when it is rotated about its centerline so that the device and the media do not have to be at right angles to one another. FIG. 2 also shows that when the device engages media, at some point during the cutting process, media contact point 28*a* of the sidewall makes contact with first major surface 81 of the media while cutting edge 51 of the blade makes contact with second opposite major surface 82 of the media.

Figure 3:
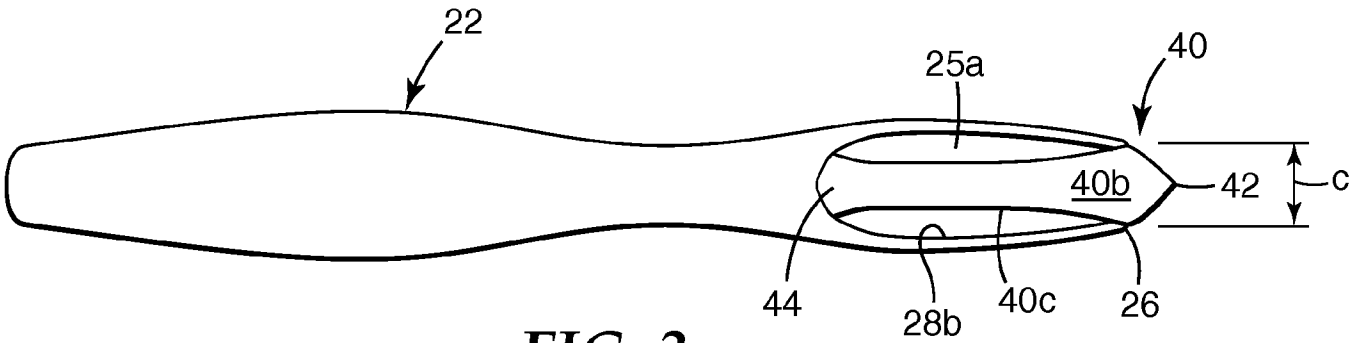
FIG. 3 is bottom plan view of the embodiment of FIG. 1.

FIG. 3 is a bottom view of the device showing, among other things, inside surface 25*a* of the cover along with optional guide 40 with its bottom surface 40*b* exposed to the reader. Free end 42 of the guide extends beyond exposed end 26 of the cover. While the guide shown in FIG. 3 has an elongated neck with a pointed end, other designs for the guide can be used.

For example, the free end can be of a shorter length than what is shown in FIG. 3 not reaching to the exposed end of the cover. In one embodiment, the width of the free end as measured near the exposed end of the cover, denoted generally as "c", is larger than the width of the sidewall near the same point. In other embodiments, the width of the guide, taken at any distance from the attached end of the guide, can be greater or less than the widest width of the sidewall. In one embodiment, the largest distance between inside surface 28*b* of sidewall 28 to the edge 40*c* of the guide is sufficiently small so as to prevent the user from inserting his or her finger into that region. This design feature is intended to deny the user access to the cutting edge of the blade. In this embodiment, the free end of the guide is pointed, so as to allow piercing of the media. The piercing provides another method for starting the cutting process.

Near attached end 44, the guide is tapered. The attached end can also be narrowed as compared to the rest of the guide. These design features facilitate the cutting process, as the tapered or narrowed regions allow for easy passage of the media away from the device reducing hang up and/or distortion of the cut media. In one embodiment, bottom surface 40*b* of the guide can include extensions, such as a rib (FIG. 13), that would fit into a corresponding mating channel on a cutting surface. For example, in some fabric stores, a salesperson cuts a piece of fabric on a countertop that has grooves or channels to guide the cutting device used, so as to cut as straight of a line as possible. The rib can also be attached to one side of the guide, to register it from an edge, again in an effort to cut as straight of a line as possible.

As can be seen from FIG. 3, the sidewalls are curved in cross-section. Thus, the sidewall has compound curves, the first being the curved surface near the cover and the second being the cross-sectional curvature of the sidewall. The sidewall can be rigid so as to be stiff and unyielding in use or it can be flexible so as to deflect when used with the media.

Figure 4:
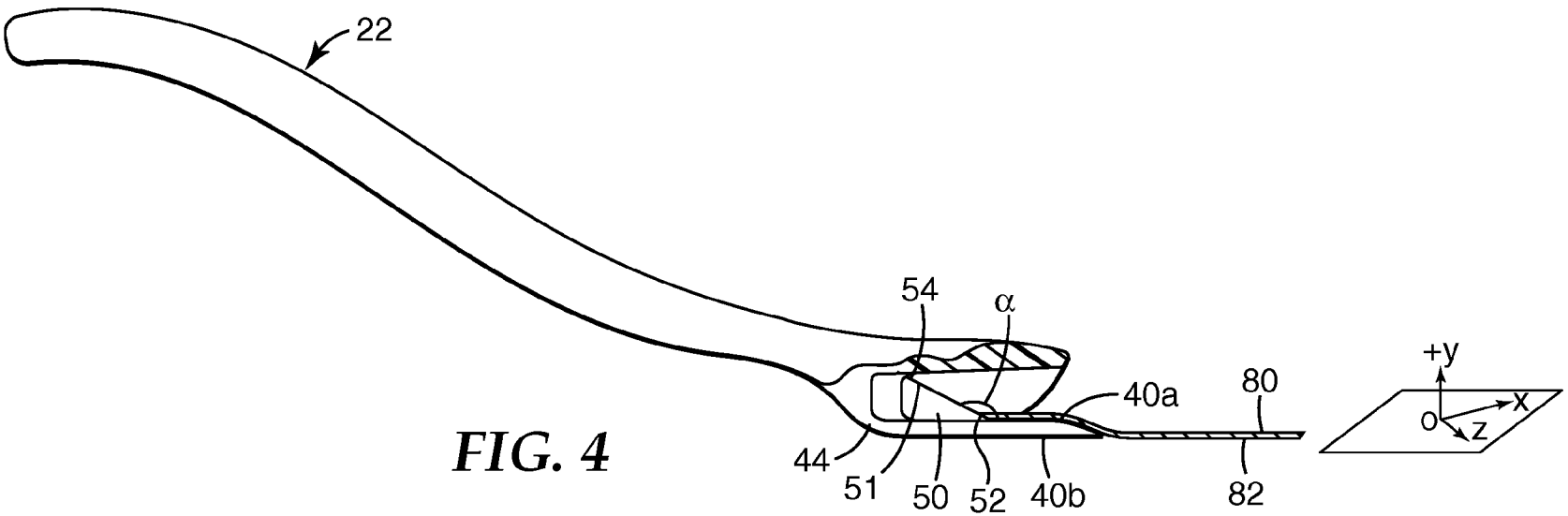
FIG. 4 is a side view of the embodiment of FIG. 1 with a portion of the sidewall cut away for illustrative purposes.

FIG. 4 shows a side view of the cutting device with a portion of the sidewall cut away for ease of understanding. Optional guide 40 has a top surface 40*a* opposite from bottom substantially planar surface 40*b*, which is coplanar to the horizontal plane of the media. The guide can facilitate pick up of the media and, as stated previously, can function as a visual aid to help align the device with the media. Attached end 44 of the guide extends from the handle. Blade 50 is disposed in the guide such that its cutting edge 51 is exposed to the media. The cutting edge has leading edge 52 and trailing edge 54. In this particular embodiment, leading edge 52 lies proximate to top surface 40*a* while trailing edge 54 lies near attached end 44. The media contact point of the sidewall is disposed away from trailing edge 54 in the direction of leading edge 52. In one embodiment, the media contact point on the sidewall lies between the leading edge and the trailing edge. In another embodiment, the media contact point of the sidewall extends beyond the leading edge of the blade but not beyond bottom surface 40*b* of the guide.

FIG. 4 also shows that when media 80 contacts cutting edge 51, an angle $\alpha$ is created between second major surface 82 of the media and the cutting edge. The device is operable when the angle $\alpha$ is any value except about 180°, which is the case where the cutting edge is parallel to the horizontal plane of the media.

For reference purposes, a Cartesian coordinate system is presented in FIG. 4 where intersecting axes x and z define a plane and axis y is orthogonal to the x and z axes. An origin, O, defines the intersection of the three axes. When the origin coincides with leading edge 52, with the x-z plane lying substantially coplanar with surface 40*a*, trailing edge 54 lies in the positive y (+y) direction, which is illustrated, in FIG. 4, to be above the x-z plane.

Figure 12:
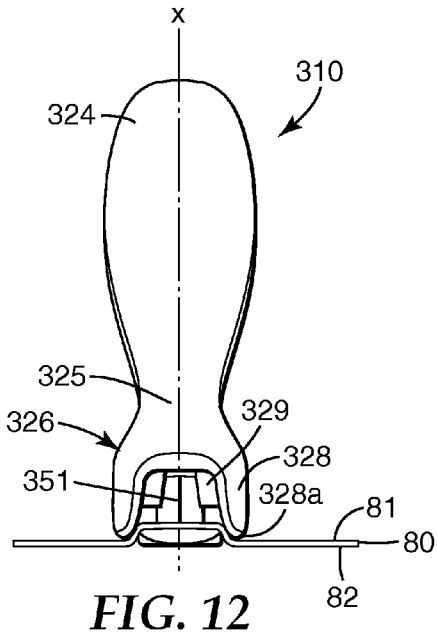
FIG. 12 is a front view of another embodiment of the present invention.

FIG. 12 shows another exemplary embodiment of the present invention. Similar to the embodiment of FIG. 1, cutting device 310 includes handle 324 and housing 326. The housing includes cover 325 and sidewall 328. When the device engages media, at some point during the cutting process, first media contact point 328*a* of the sidewall makes contact with first major surface 81 of media 80 while cutting edge 351 makes contact with second opposite major surface 82. As the device slides through the media during cutting, the media may travel along the cutting edge eventually to encounter second media contact point 329. Among the various functions of the second media contact point, it serves a way to minimize the possibility that uncut media will gather at the trailing edge of the blade, which would cause tearing in the media. In other words, with the use of the second media contact point, the media will most likely be cut before it reaches the trailing edge of the blade.

Figure 13:
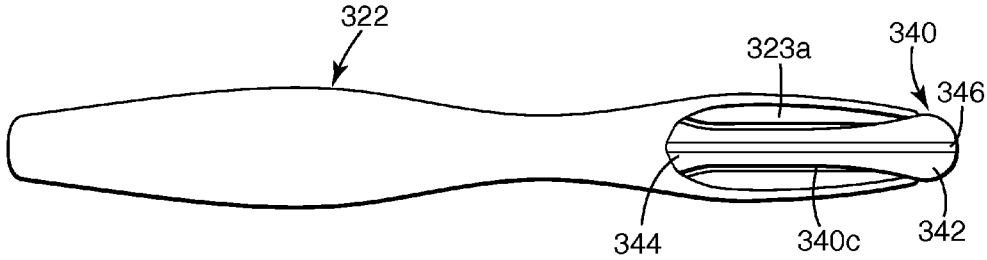
FIG. 13 is a bottom plan view of the embodiment of FIG. 12.

FIG. 13 is a bottom view of the device of FIG. 12 showing guide 340 and inside surface 323*a* of the housing. The guide further includes rib 346 extending substantially from attached end 344 to free end 342 of the guide. The second media contact point is disposed on an inside surface of the housing. The second media contact point can extend from the cover, from the sidewall, or from the combination thereof. Whether or not the media will encounter the second media contact point during the cutting operation depends upon several factors, including but not limited to, the weight and or thickness of the media, the speed of cutting, and the orientation of the cutting edge with respect to the media.

FIGS. 5 to 8 show another exemplary embodiment of the present invention where device 60 is shown in its cutting orientation. The device includes body 62 and blade 70 disposed in the body. In this particular embodiment, the body is in the form of an ergonomic designed handle 64 with a substantially planar base 65. The body also includes transition zone 63 (FIG. 7) that connects the handle to the base. The plane that defines the base is substantially coplanar with the plane of the media. Sidewall 68 extends from the base to shroud at least a portion of a cutting edge of the blade. The sidewall can be of any geometry so long as it has a media contact point, denoted as reference 68*a*. In one embodiment, the base includes reference mark 67 to help the user align the device with the media. In FIG. 5, reference mark 67 lies midway on the base, although the reference mark can be in other location. In one embodiment, the handle, transition zone, and base are integrally formed. It is within the scope of the present invention to have each component formed separately and then joined together by any suitable means. The base also has first exposed end 66, which is the end that includes a direct line of sight to the cutting edge. The device also has a second exposed end, as can be seen in the rear view of FIG. 7. The body has a centerline, generally denoted as reference line "y".

Figure 6:
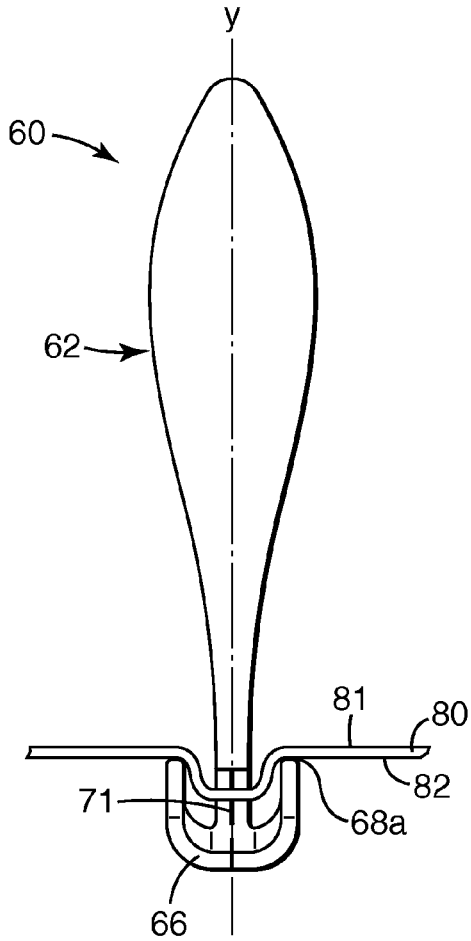
FIG. 6 is a front view of the embodiment of FIG. 5.
Figure 7:
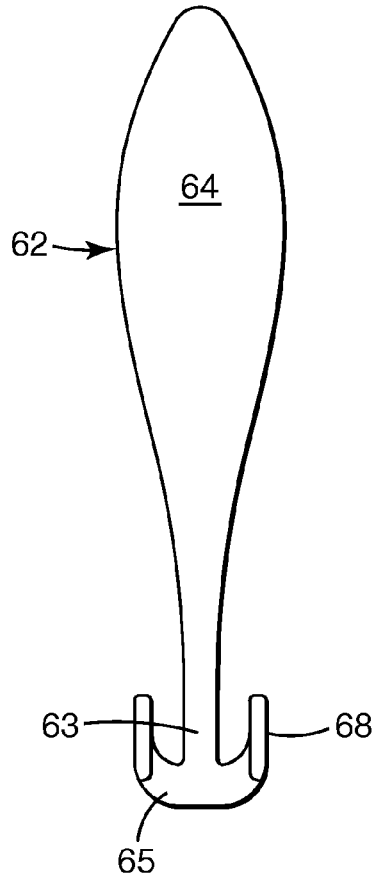
FIG. 7 is a back view of the embodiment of FIG. 5.

With reference to FIG. 6, when the device engages media 80, at some point during the cutting process, media contact point 68*a* of the sidewall makes contact with second major surface 82 of media 80 while cutting edge 71 makes contact with an opposite first major surface 81. FIG. 7 shows a back view of the device where transition zone 63 is tapered or narrowed. Similar to the tapered or narrowed attached end of the guide in the embodiment of FIG. 1, the tapered or narrowed transition zone allows for easy passage of the media away from the device and can also reduce hang up and/or distortion of the cut media.

Figure 8:
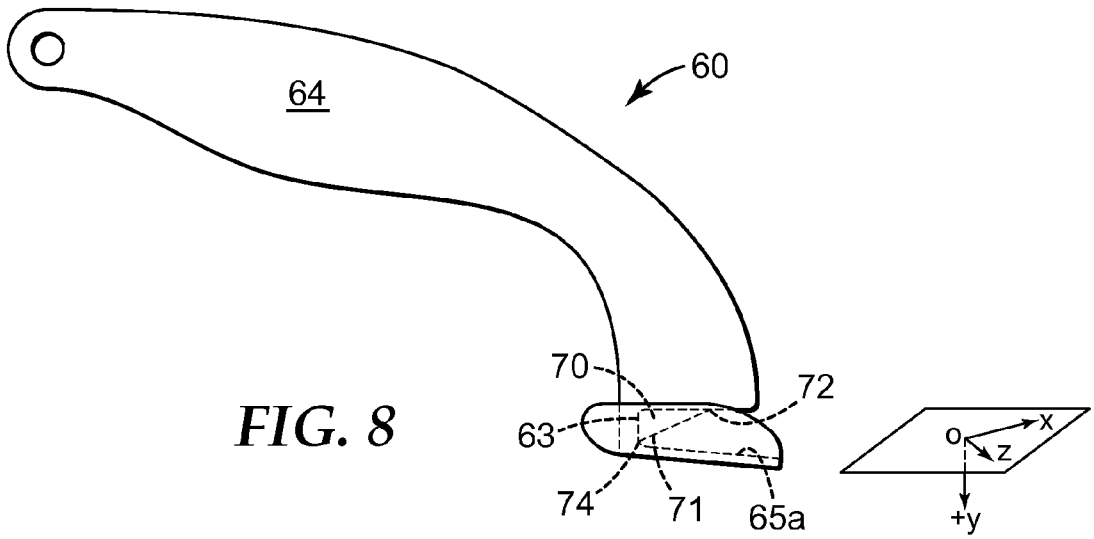
FIG. 8 is a side view of the embodiment of FIG. 5 with hidden features shown in phantom.

With reference to FIG. 8, blade 70 is disposed in the transition zone. The blade has cutting edge 71, leading edge 72, and trailing edge 74. Media contact point 68*a* of the sidewall is disposed away from trailing edge 74 in the direction of leading edge 72. In one embodiment, the media contact point lies between the leading edge and the trailing edge. In another embodiment, the media contact point on the sidewall extends beyond the leading edge. A Cartesian coordinate system is presented in FIG. 8 for reference purposes. When the Cartesian coordinate system is placed so that the origin coincides with leading edge 72, trailing edge 74 lies in the positive y (+y) direction.

Figure 9:
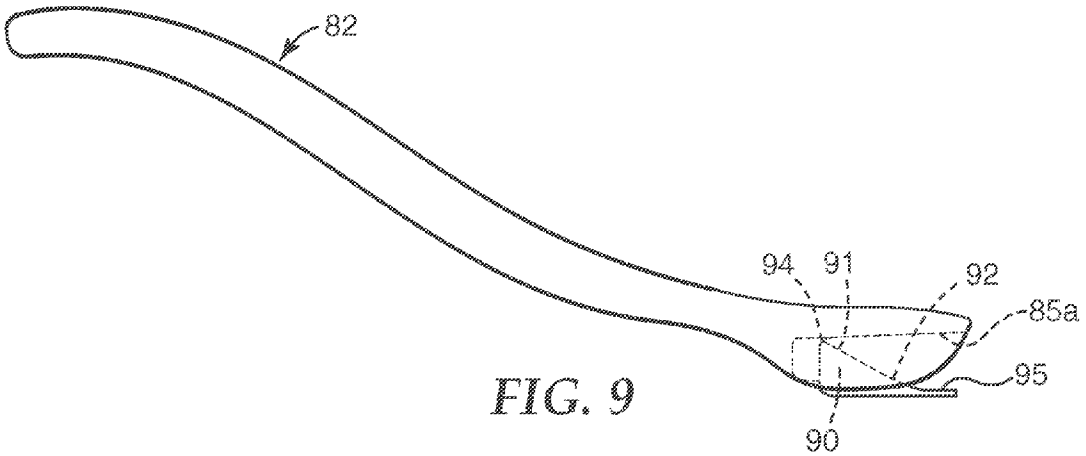
FIG. 9 is a perspective view of another exemplary embodiment of the present invention with hidden features shown in phantom.

FIG. 9 shows another exemplary embodiment of the present invention similar to the embodiment shown in FIG. 4. The embodiment in FIG. 9 includes a body 82 and blade 90 disposed in the body. The blade has cutting edge 91 and non-cutting portion 95. The cutting edge has leading edge 92 and trailing edge 94, which is disposed near inner surface 85*a* of the cover. The non-cutting portion of blade cab facilitate the lifting of the media into the cutting edge of the device.

In use, typically the device engages an edge of the media. As the device slides further into the media, the cutting edge in combination with the sidewall, particularly the media contact point on the sidewall, deforms the media so that it no longer lies in one continuous plane from one side of the device to the other side of the device. The deformation occurs in the area of the media that is presented to the cutting edge (the "presented area"). In the embodiments of FIGS. 1, 5, and 9, the presented area is the area between the sidewalls and on that portion of the cutting edge that makes contact with the media. In the embodiment where only one side wall is present, the presented area is the region between the sidewall and the cutting edge that has made contact with the media. The magnitude of the deformation is determined by factors such as, e.g., the weight, stiffness, and thickness of the media, and the location of the media contact point with respect to the trailing edge. There may be other factors that determine the magnitude of the deformation. In one embodiment, during the cutting process, the media does not come into contact with inside surface of the cover, shown generally reference numbers 25*a* and 65*a* in FIGS. 3 and 8 respectively of the two embodiments. During the cutting process, the sidewall may exert various frictional forces on the media. There is at least one frictional force that opposes the media from riding up the cutting edge.

In another aspect, the present invention relates to a cutting device containing replaceable parts. For example, in the embodiment of FIG. 1, the cover and sidewall may be integrally formed and the combination may be replaceable so as to accommodate different types of media. The guide may be replaceable to introduce a new cutting edge. The handle may be replaceable. Similarly, for the embodiment in FIG. 5, the base and sidewall may be integrally formed and the combination may be replaceable so as to accommodate different types of media. The transition zone may be replaceable to introduce a new cutting edge.

Figure 10A:
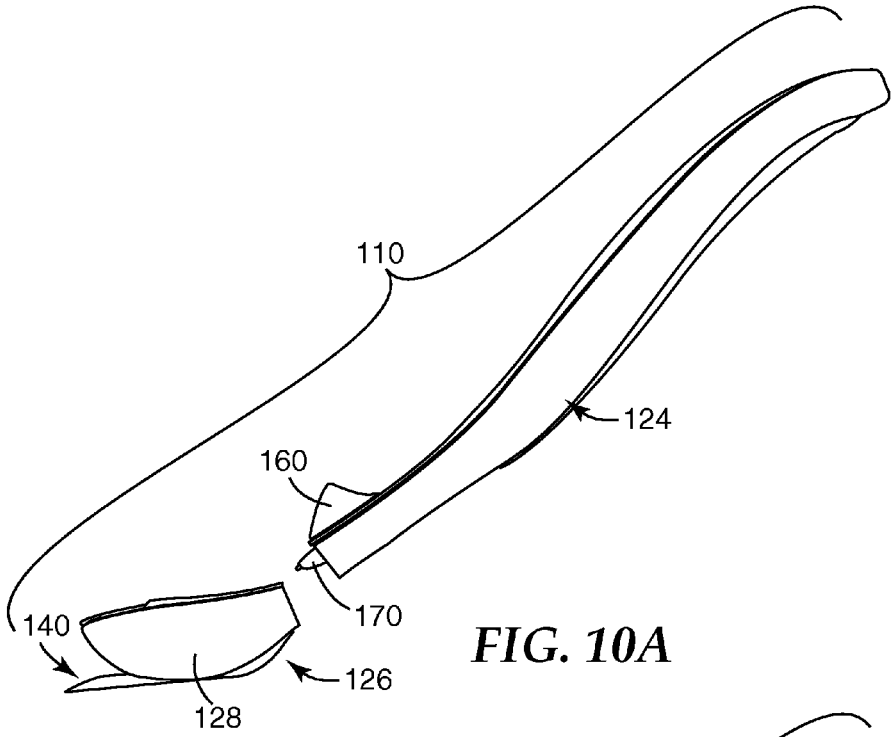
FIGS. 10A and 10B are side views of various embodiments showing a cutting device with replaceable parts.
Figure 10B:
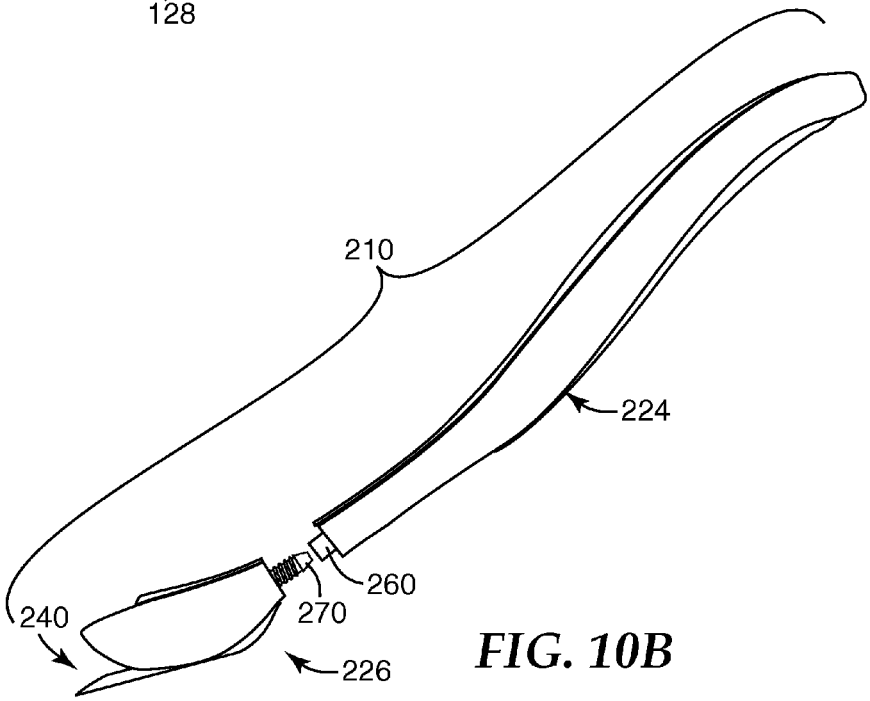

FIGS. 10A and 10B show exemplary cutting devices with replaceable parts. In FIG. 10A, cutting device 110 includes handle 124 and housing 126 that can be attached together using male part 170 in the handle and mating female part (not shown) in the housing. The housing includes a cover and sidewall 128 and optionally guide 140. The housing can be engaged and disengaged from the handle using any of a variety of mechanical means, and FIG. 10A shows the use of tab 160 as a convenient way for the consumer to disassemble the head from the handle. In FIG. 10B, cutting device 210 includes handle 224 and housing 226 that can be attached together using a combination of threaded screw 270 disposed on the head and receptacle 260 on the handle for receiving the threaded screw. Other mechanical devices can be used attach the two parts, such as, e.g., a ball and socket or a key way, allowing them to be snapped together or apart.

Figure 11:
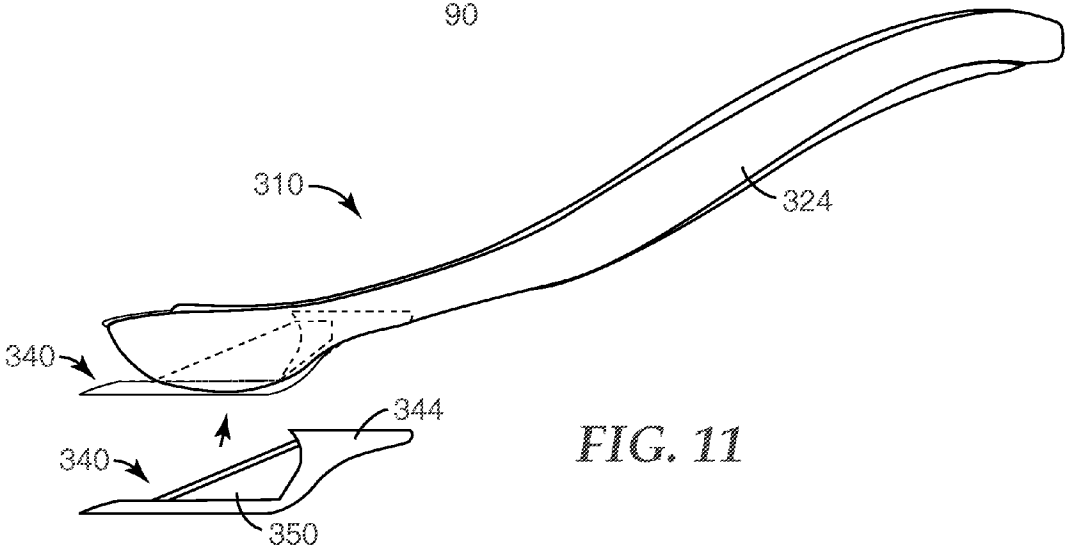
FIG. 11 is a side view of an embodiment showing the cutting device with replaceable guide and blade.

FIG. 11 shows another illustrative embodiment where the guide is replaceable. Cutting device 310 includes handle 324 and replaceable guide 340 having blade 350. In use, when the blade becomes dull or when the blade needs to be changed due to cutting a new media, the user would disengage the guide from the handle and install a new or different guide. The replaceable guide can disassembled from the handle at attached end 344 and the handle would have a corresponding means to allow for the engaging and disengaging of the guide.

Figure 14:
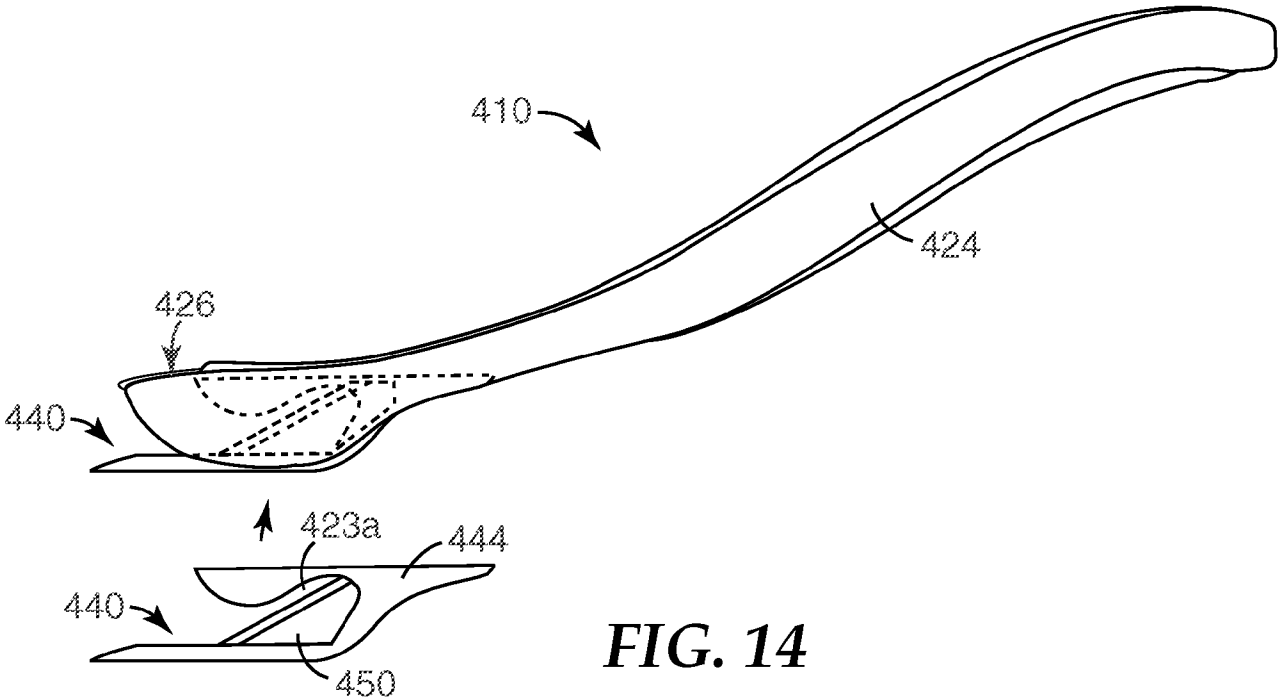
FIG. 14 is a side view of another embodiment showing a cutting device with replaceable parts.

FIG. 14 shows another illustrative embodiment where the guide is replaceable. Cutting device 410 includes handle 424 and replaceable guide 440 having blade 450. The replaceable guide further includes second media contact point 423*a*. Once the guide is attached to housing 426, the second media contact point lies proximate to the cover of the housing.

In one embodiment, the handle, housing, and guide are integrally formed. It is within the scope of the present invention, however, for the components to be formed separately and joined together by any suitable means. Whether or not integrally formed, the body may be made of any variety of materials, including metal, wood, polymer, ceramics and composites thereof. Injection moldable polymers are also useful. Suitable polymers include, but are not limited to polyolefins, such as, but not limited to polypropylene, polystyrene, high impact polystyrene, and ABS (acrylonitrile-butadiene-styrene copolymer). The body could be made of a combination of polymers. For example, in one embodiment, the body could be made of two polymers, one of which is softer, in terms of durometer, than the rest of the body, so as to provide a soft touch effect. The two polymers may also have different colors.

The means for cutting the media may be a blade or a wire made from a variety of materials, including metals, ceramics, and plastics. Suitable metals include, but are not limited to, stainless steel, cold rolled steel, cold rolled nickel plated steel, copper and brass. The cutting edge may be a straight edge or it may be beveled, chiseled, serrated, corrugated, scalloped, or curved. The means for cutting the media may be of any number of geometries, including e.g., triangular, rectangular or circular. The circular geometry can be advantageous in that if the cutting edge becomes dull, the device can be designed so as to rotate the cutting edge to expose a fresh cutting edge. This design feature extends the life of the blade or wire without having to replace it. An advancing mechanism can be designed into the body to allow for rotation of the cutting edge. Yet another design would include a swivel blade with a ball joint and a lock. In yet another embodiment, the means for cutting the media can include two rounded wheels that make contact with one another and where the cutting action occurs as the wheels rotate against one another.

The means for cutting the media can include a plurality of blades or wires. In one embodiment, two blades spaced apart at a desired distance, such as, e.g., ¼ inch (2.54 mm), can be used to cut predetermined widths of strips of media. The device can be designed so as to allow for passage of the strips.

Turning now to the combination of an exemplary media cutting and ribbon curling device (sometimes referred to herein as the "combination device"), FIGS. 15 to 20 better describe aspects of the various embodiments. In this combination device, in general, the handle includes a ribbon curling region located near the head.

Figure 15:
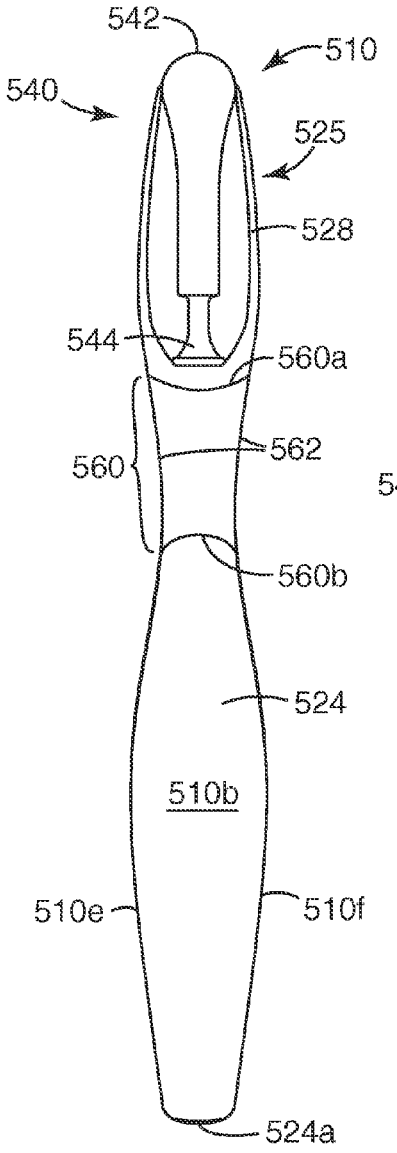
FIG. 15 is a bottom plan view on an exemplary media cutting and ribbon curling device.

FIG. 15 shows a bottom plan view of an exemplary a media cutting and ribbon curling device 510 that includes a head 525 and a handle 524 extending therefrom. The handle has a rear end 524*a*. The head includes a cover (not labeled) having sidewalls 528 extending therefrom, and an optional guide 540 disposed substantially underneath the cover. The guide has an attached end 544 closest to the handle, and a free end 542, which in one embodiment, extends beyond the cover. A cutting device, such as a blade, is disposed in the guide. The combination device includes opposing first surface 510*a* and second surface 510*b* bound by two side edges, 510*e* and 510*f*. The second surface of the device lies on the same side as the guide. On the handle and on at least one of the first and second surfaces of the combination device, there is a ribbon curling region 560 that has a first end 560*a* and a tapered second end 560*b*, i.e., as compared to the first end, the second end has a narrower dimension, as seen from the bottom plan view of the device. The first end of the ribbon curling region is proximate to the head, and more specifically, proximate to the attached end of the guide. The ribbon curling region has a curling edge 562 formed by a juncture of, in this case, the second surface of the device and one of the side edges.

In some embodiments, the combination device may have more than one curling edge. In one embodiment, and as shown particularly in FIG. 15, the combination device includes two curling edges, disposed symmetrically on the device, which is particularly convenient, as it allows for left-handed as well as right-handed use during ribbon curling. Furthermore, multiple curling edges extend the life of the ribbon curling feature of the device because when one edge is worn, another edge is available for use. Another method to extend the life of the curling edge and or the entire ribbon curling region involves selecting a material that has improved hardness and wear resistance, so that after multiple uses, the radius of curvature of the curling edge (as described below) has not changed substantially and is within the limits recited. Suitable materials for the curling edge include plastics, metals, and ceramics. Suitable plastics include, without limitation, polycarbonate, polystyrene, ABS, and acetal.

Figure 16:
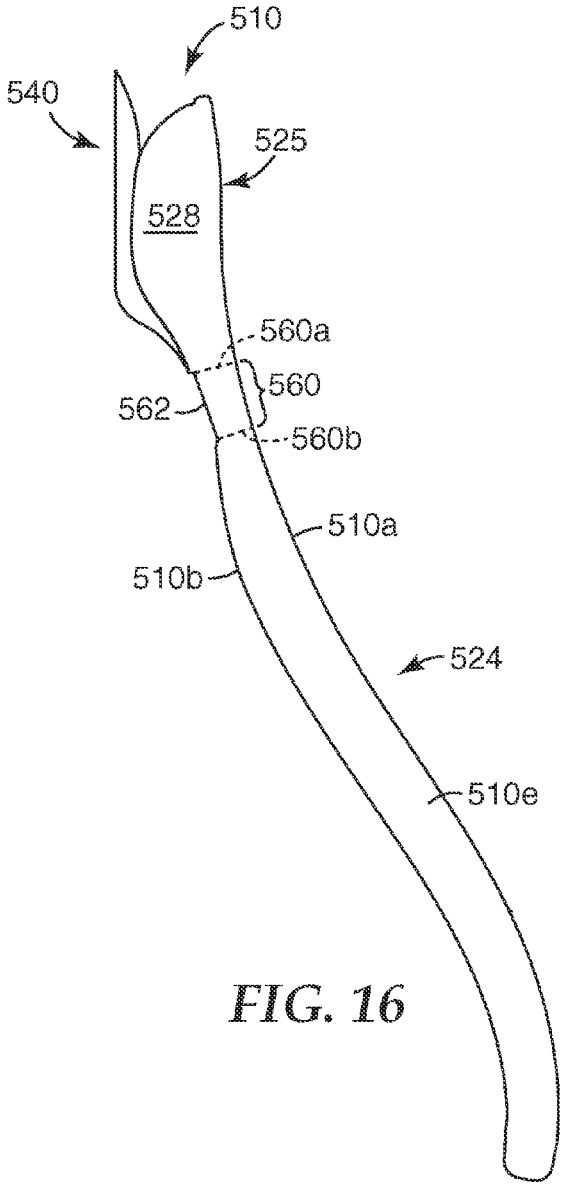
FIG. 16 is a side view of another exemplary media cutting and ribbon curling device.

FIG. 16, a side view of the device of FIG. 15, view shows that the ribbon curling region necks down, in terms of thickness, from the rest of handle and. Thus, in this embodiment, the ribbon curling region can be described as being located in a throat of the device.

Figure 17:
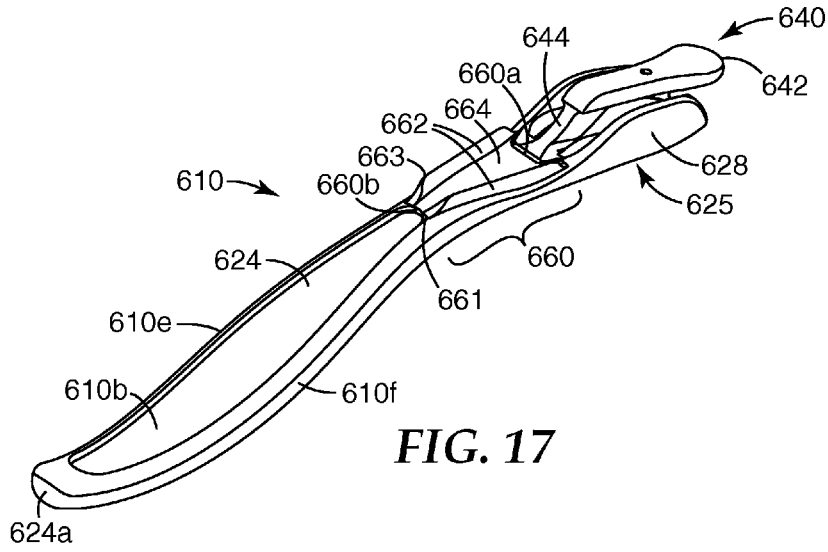
FIG. 17 is a bottom perspective view of another exemplary media cutting and ribbon curling device.

FIG. 17 shows a bottom plan view of another exemplary media cutting and ribbon curling device 610 that includes a head 625 and a handle 624 extending therefrom. The handle has a rear end 624*a*. The head includes a cover (not labeled) having sidewalls 628 extending therefrom, and an optional guide 640 disposed substantially underneath the cover. The guide has an attached end 644 closest to the handle, and a free end 642, which in one embodiment, extends beyond the cover. A cutting device, such as a blade, is disposed in the guide. The combination device includes opposing first surface (not shown) and second surface 610*b* bound by two side edges, 610*e* and 610*f*. The second surface of the device lies on the same side as a guide. On the handle and on at least one of the first and second surfaces of the device, there is a ribbon curling region 660 that has a first end 660*a* and a tapered second end 660*b*, i.e., as compared to the first end, the second end has a narrower dimension, as seen from the bottom plan view of the device. The first end of the ribbon curling region is proximate to the head, and more specifically, proximate to the attached end of the guide. The ribbon curling region includes two curling edges 662 that are formed from rails that extend from the second surface of the device. While the rails are shown to be immediately adjacent to the side edge of the device, it can be located in other positions in the ribbon curling region. For example, the rail can be towards the center of the ribbon curling region. In this particular embodiment, the rails have a substantially triangular cross section where the base 661 of the triangle lies on the second surface of the device and a tip 663 of the triangle extends from the triangle's base. The exposed sides of the triangle (i.e., not the base of the triangle) may have curvature. If one were to draw two tangent lines, one for each of the exposed side, each passing through the tip of the triangle and measure the angle between those two tangent lines, the angle is less than about 90°. In one embodiment, the angle is less than about 60°. It should be noted that the tip of the triangle may not be a distinct sharp point but instead may include a plateau. The tip of the rail is the ribbon contact point. If one were to measure the radius of curvature of the tip, it is less than about 0.02 inch (0.51 mm). In one embodiment, the radius of curvature of the tip is less than about 0.015 inch (0.38 mm). The radius of curvature of the rail, however, is greater than 0.001 inch (0.025 mm) because below this limit, the radius may be too sharp thereby abrading and causing damage to the ribbon. At a radius of greater than about the recited upper limited of 0.02 inch, the ribbon contacts too large of a surface area to provide effective curling.

In between the two curling edges lies land 664. The height of the rail, as measured perpendicular to the land, is less than about 0.2 inch (5.1 mm). In one embodiment, the rail height is less than about 0.12 inch (2.9 mm). The rail height, however, should be greater than about 0.01 inch (0.25 mm) because it should provide a feature of the ribbon curling edge. The land in between the rails provides a region for the user to balance, rest, and support the rest of his finger while curling the ribbon thereby minimizing any rocking of the finger as well as providing comfort for the user during use. If the rail height was too large, i.e., greater than the upper limit of about 0.2 inch, the likelihood of finger rocking increases. While the substantially triangular cross-section rail described herein provides utility as the curling edge, other designs could be used. For example, one could use a wedge shape design.

Figure 18:
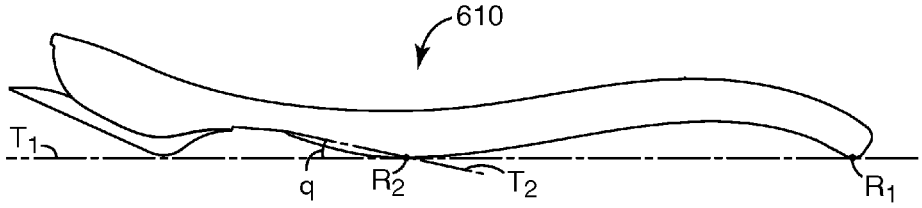
FIG. 18 is a side view of an exemplary media cutting and ribbon curling device.

FIG. 18 is a side view of the combination device of FIG. 17 placed on a substantially planar surface (e.g., a table top) such that the optional guide is adjacent to the planar surface. A first plane can be defined to encompass the curling edge and is coplanar with the second surface of the device in the ribbon curling region. The first plane is illustrated schematically in two-dimensions, as line $T_1$. The handle of the device is curved such that when placed on the planar surface, two resting points support the device. The first resting point, $R_1$, lays on the second surface and at the rear of the handle. A second resting point, $R_2$, also lies on the second surface of the handle and near the ribbon curling region. A second plane can be defined to encompass both resting points and is denoted as line $T_2$. The intersection of the first and second planes creates an angle θ. In one embodiment, the angle is greater than about 5° and less than about 80°. In another embodiment, the angle is about 10°.

The design of the handle with the particular curvature makes the device particularly comfortable for use in the cutting mode or in the ribbon curling mode. In the cutting mode, the user may grasp the handle around her palm, with one side of the device, e.g., side 610*e* in contact with the thumb and the opposing side, side 610*f*, in contact with the side of her index finger, and the back of the hand generally facing her. In the ribbon curling mode, the same grasp can be used, however, the back of her hand faces away from her and her fingers may all be within her direct line of sight. This grasp is particularly useful for curling ribbon as the angle θ is in the range where the thumb rests comfortably and securely against the ribbon curling edge. That is, the angle θ is designed such that the largest part of the thumb is resting against the ribbon curling edge and against the side of the index finger closest to the knuckles of the hand. It would be less desirable to have a ribbon curling region where the thumb, when grasping the device in anticipation of curling ribbon, is far away from the side of the index finger, such as, e.g., when the thumb is in the hand gesture of a "thumbs up" position because only a minimal force can be applied to the ribbon.

In the combination device, the head and handle, along with the ribbon curling region can be integrally formed or it can be formed separately and attached to the handle by any suitable means. Illustrative attachment techniques include, without limitation, mechanical means, such as, without limitation, heat welding, ultrasonic welding, screws and corresponding threads, pins and corresponding holes, and adhesives means, such as, without limitation, liquid adhesives such as cyanoacrylates and double coated tape.

Figure 19:
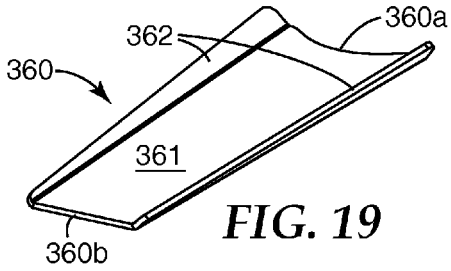
FIG. 19 is a perspective view of an exemplary ribbon curling region that can be formed separately from a media cutting device and then attached thereto.

FIG. 19 is a perspective view of an exemplary ribbon curling region 360 that can be formed separately and attached to the media cutter to form the combination device. The ribbon curling region has a first and second ends, 360*a* and 360*b* respectively, where the second end is tapered, i.e., narrower in dimension as compared to the first end. The ribbon curling region also has two curling edges 362 separated by land 361. The land has opposing top and bottom surfaces where, upon attachment to a media cutter, the bottom surface would be proximate to and perhaps in contact with the first or second surface of the device.

Figure 20:
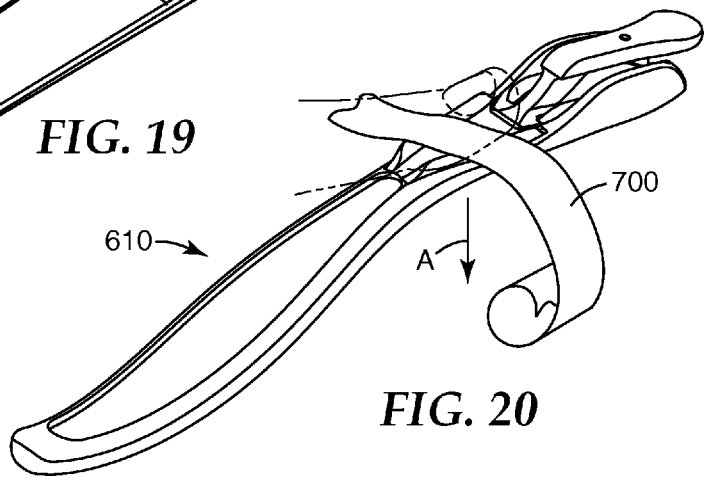
FIG. 20 is a schematic view of a method of curling a ribbon using the device of FIG. 17.

FIG. 20 is a schematic view of an exemplary process of curling a length of ribbon 700 using the device of FIG. 17. The ribbon has been wedged between a consumer's thumb (shown in phantom) and one of the curling edges. To curl the length of ribbon, the consumer pulls the ribbon in the direction indicated by the arrow A, although alternative methods can be used.

If desired, the combination device can be formed of a first polymeric material and a second polymeric material can be used on at least one of the first and second surfaces of the device. The first and second polymeric material can be of the same material. In an alternative embodiment, the first and second polymeric materials have different properties, such as, without limitation, different hardness or softness (in terms of durometer), different colors, and a combination of these two properties. In one embodiment, the handle, whether on the first surface or the second surface, includes two different polymeric material, the first material substantially forming the overall shape of the handle, and the second material covering over a portion of the first material, the second material being softer and of a different color. In this way, the combination device has aesthetic appeal while providing a soft touch effect providing better even better gripping action for the consumer.

Although specific embodiments of the present invention have been shown and described, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A media cutting and ribbon curling device having opposing first and second surfaces bound by first and second opposing side edges, the device comprising:

a head comprising a cover and a guide disposed substantially underneath the cover, the guide having an attached end and a free end and a blade disposed therein; and an elongated handle extending from the attached end of the guide, the handle comprising a ribbon curling region having (i) first and second ends, the first end disposed proximate to the attached end of the guide and (ii) a curling edge disposed immediately adjacent to the first side edge of at least one of the first and second surfaces of the device, the ribbon curling region being tapered at its second end such that the distance separating the curling edge and the opposing second side edge at its second end is less than the distance separating the curling edge and the opposing second side edge at its first end, wherein the curling edge comprises a rail that extends from the device, the rail having a base and a highest point, the base being disposed on the device and the highest point being furthest away from the device and having a radius of curvature greater than about 0.025 mm and less than about 0.51 mm.

2. The device of claim 1, wherein the curling edge of the ribbon curling region is formed by a juncture of the first side edge and one of the first and second surfaces.

3. The device of claim 2, wherein the juncture is about a 90° angle.

4. The device of claim 1, wherein the ribbon curling region further comprises a land next to the curling edge.

5. The device of claim 4, wherein the rail has a minimum height of greater than about 0.25 mm and a maximum height of less than about 5 mm, the height being measured perpendicular to the land and the highest point on the rail.

6. The device of claim 1, wherein the rail has a substantially triangular cross-section having a base disposed on the surface of the device, two exposed sides, and a tip that extends from the base.

7. The device of claim 6, wherein two tangent lines, one for each of the exposed sides and passing through the tip, intersect at an angle less than about 90°.

8. The device of claim 6, wherein two tangent lines, one for each of the exposed sides and passing through the tip, intersect at an angle less than about 60°.

9. The device of claim 1, wherein the curling edge is formed from a wear resistant material selected from the group consisting of plastic, metal, and ceramic.

10. The device of claim 9, wherein the plastic is selected from the group consisting of polycarbonate, polystyrene, acrylonitrile-butadiene-styrene copolymer, and acetal.

11. The device of claim 1, wherein the ribbon curling region is formed integrally with the handle.

12. The device of claim 1, wherein the ribbon curling region is formed separately from the handle and attached to the handle using mechanical and or adhesive attachment means.

13. The device of claim 1, wherein at least one of the head and the handle is formed from a first polymeric material and wherein at least one of the first and second surfaces of the handle include a second polymeric material having a characteristic selected from the group consisting of a lower durometer than the first polymeric material, a different color than the first polymeric material, and a combination thereof.

14. The device of claim 1, wherein the curling edge is disposed on the second surface of the device, and wherein an angle θ is formed between (i) a first plane that encompasses the curling edge and is substantially coplanar with the second surface of the device in the ribbon curling region and (ii) a second plane encompassing first and second resting points on the second surface of the device when it is placed on a substantially planar surface, the angle θ being greater than about 5° and less than 80°.

15. The device of claim 14 wherein the angle θ is about 10°.

16. The device of claim 1, wherein the handle includes curvature such that when the device is placed on a substantially planar surface, the device rests on two resting points located on its second surface, a first resting point at a rear of the handle and a second resting point proximate to the ribbon curling region.

17. A media cutting and ribbon curling device having opposing first and second surfaces bound by two opposing side edges, the device comprising:

a head comprising a cover and a guide disposed substantially underneath the cover, wherein the guide has an attached end and a free end and a blade disposed therein and wherein the second surface of the device is on the same side as the guide; and an elongated handle extending from the attached end of the guide, the handle comprising a ribbon curling region having (i) first and second ends, the first end disposed proximate to the attached end of the guide and (ii) two curling edges disposed on the second surface of the device, wherein the curling edges are formed from substantially triangular cross-section rails, each rail having a base disposed on the second surface of the device and a tip extending from the base and wherein the tip has a radius of curvature greater than about 0.025 mm and less than about 0.51 mm and the ribbon curling region is tapered at its second end such that the distance separating the two curling edges at the second end is less than the distance separating the two curling edges at the first end.

18. A method of curling a ribbon comprising the steps of:

providing a length of ribbon;

providing the media cutting and ribbon curling device of claim 1;

placing the ribbon against the curling edge;

placing a thumb across the curling edge on the device pushing the ribbon against the curling edge; and pulling the length of the ribbon through while maintaining the ribbon against the curling edge.

* * * * *